US005743088A

United States Patent [19]

Grath

[11] Patent Number: 5,743,088

[45] Date of Patent: Apr. 28, 1998

[54] TRIAD EXHAUST SYSTEM

[76] Inventor: Francis R. Grath, 28 Berkshire La., Palm Coast, Fla. 32137

[21] Appl. No.: 823,228

[22] Filed: Mar. 24, 1997

[51] Int. Cl.[6] ..... F01N 7/00

[52] U.S. Cl. ..... 60/324; 181/236

[58] Field of Search ..... 60/324; 181/236

[56] References Cited

U.S. PATENT DOCUMENTS

| | | | |
|---|---|---|---|
| 1,658,766 | 2/1928 | Gray . | |
| 2,492,784 | 12/1949 | Christman | 181/236 |
| 2,625,234 | 1/1953 | Fina . | |
| 3,346,071 | 10/1967 | Lader | 181/236 |
| 4,715,472 | 12/1987 | McKee . | |
| 4,773,215 | 9/1988 | Winberg et al. . | |
| 4,795,420 | 1/1989 | Sakurai et al. . | |
| 4,910,960 | 3/1990 | Ueki et al. . | |
| 4,913,260 | 4/1990 | Fallon | 181/236 |
| 4,999,999 | 3/1991 | Takahashi et al. . | |
| 5,452,578 | 9/1995 | Barber | 60/324 |

*Primary Examiner*—Marguerite McMahon
*Attorney, Agent, or Firm*—Paul S. Rooy

[57] ABSTRACT

A triad exhaust system comprising a diverter rotatably engaged with a muffler and an exhaust pipe. The diverter has a plurality of ports which are alignable with a muffler intake and an exhaust pipe intake. When the diverter is rotated to a "BOTH" position, diverter ports permit exhaust gasses to exit an exhaust manifold through both the muffler and the exhaust port. When the diverter is rotated to a "MUFFLER ONLY" position, a diverter port permits exhaust gasses to exit the exhaust manifold only through the muffler. When the diverter is rotated to an "EXHAUST PIPE ONLY" position, a diverter port permits exhaust gasses to exit the exhaust manifold only through the exhaust pipe. A quadrant bearing indicia is provided to permit an operator to ascertain the position of the diverter. A flexible cable may be attached to the diverter to permit operation of the triad exhaust system from a remote location such as from the motorcycle handlebars of a motor cycle. Operation of the triad exhaust system permits the operator to maximize power and noise level when the diverter is in the "EXHAUST PIPE ONLY" position. In the "MUFFLER ONLY" position, the diverter provides for a minimum sound level at the cost of reduced power. In the "BOTH" position, the diverter provides reduced sound without minimizing power available.

13 Claims, 3 Drawing Sheets

TRIAD EXHAUST SYSTEM

FIELD OF THE INVENTION

This invention relates to exhaust systems, and in particular to a triad exhaust system.

BACKGROUND OF THE INVENTION

The final design of a given machine is generally the result of a series of design compromises. One example of this phenomenon is the compromise between power and sound level embodied in an internal combustion engine muffler.

In exchange for reduced power, internal combustion engine mufflers reduce the sound accompanying the functioning of an internal combustion engine to whose exhaust manifold the muffler is connected. A common application for mufflers is in street vehicles. Cars and motorcycles on the public streets are required to conform to maximum noise requirements. This conformance is accomplished by means of mufflers installed on internal combustion engine exhaust manifolds. One price paid for this reduced sound level is a corresponding reduction in horsepower available to propel the vehicle.

Mufflers are typically installed to exhaust manifolds in a relatively permanent fashion. It is not uncommon for an acetylene torch to be required to remove a muffler for replacement. Thus, the vehicle owner must typically choose between a quiet, lower-powered vehicle, or a louder, more powerful vehicle.

This choice becomes particularly Hobbesian where motorcycles are concerned. Part of the cachet of the motorcycle mystique is the loud ramble associated with motorcycle engine operation. This loud sound is especially important to the motorcycle operator at motorcycle meets and when riding with other motorcycle operators in a social environment. Riding a loud, powerful "hog" is something of a status symbol, representing freedom from conventional societal constraints.

The dilemma confronting the motorcycle operator is this: on some occasions, it is highly desirable to operate a loud and powerful motorcycle, but on other occasions (while commuting to work, while driving in an environment intolerant of loud vehicle sounds, etc.) it is necessary to keep the motorcycle quiet to avoid getting traffic tickets and to demonstrate consideration for others ear drums. Yet conventional motorcycle mufflers are difficult and time-consuming to change. Therefore, given the current state of motorcycle muffler science, the motorcycle owner must choose either a loud or a quiet motorcycle, and then live with the choice.

EXISTING DESIGNS

A number of patents have been granted for valves, some electronically controlled, which adjusted the back pressure of an exhaust system. Examples of these patents include U.S. Pat. Nos. 4,999,999, 4,910,960, 4,795,420, and 4,715,472 granted to Takahashi et al., Ueki et al., Sakurai et al., and McKee respectively. While these patents taught mufflers with valves which served to vary the resistance which exhaust gases encountered during their travels through the muffler, none provided a simple means to bypass the muffler entirely.

U.S. Pat. Nos. 4,773,215 and 2,625,234 were granted Winberg et al. and Fina respectively. While these patents taught a valved exhaust pipe communicating with a muffler, neither disclosed a valve which is capable of de-selecting the muffler entirely. In addition, Winberg et al. taught a pneumatic valve actuation system, which suffered from the disadvantages of complexity and associated increased cost.

SUMMARY OF THE INVENTION

Accordingly, it is an object of the present invention to provide a triad exhaust system which allows exhaust gasses to bypass the muffler completely. Design features allowing this object to be accomplished include a diverter plate in rotatable relation to a muffler intake and to an exhaust pipe intake, and a diverter plate second exhaust pipe port. Advantages associated with the accomplishment of this object include reduced exhaust back pressure, increased power, and louder exhaust.

It is another object of the present invention to provide a triad exhaust system which allows exhaust gasses to be channeled exclusively through the muffler. Design features allowing this object to be accomplished include a diverter plate in rotatable relation to a muffler intake and to an exhaust pipe intake, and a diverter plate second muffler port. Benefits associated with the accomplishment of this object include quieter operation, and consequent reduced chances of getting traffic tickets.

It is still another object of this invention to provide a triad exhaust system which allows exhaust gasses to be channeled simultaneously through the muffler and the exhaust pipe. Design features enabling the accomplishment of this object include a diverter plate in rotatable relation to a muffler intake and to an exhaust pipe intake, a diverter plate first muffler port, and a diverter plate first exhaust pipe port. Advantages associated with the realization of this object include reduced sound, yet more power than if all the exhaust gasses were channeled through the muffler.

It is another object of the present invention to provide a Triad Exhaust System which is easy to operate. Design features allowing this object to be accomplished include a diverter handle in close proximity to a quadrant bearing indicia, and a flexible cable attached to the diverter handle. Benefits associated with the accomplishment of this object include ease and surety of operation.

It is another object of the present invention to provide a triad exhaust system which is easily retrofittable to existing exhaust systems. Design features allowing this object to be accomplished include an exhaust manifold of standard size which may simply be installed on an existing exhaust system in place of the original exhaust manifold. Benefits associated with the accomplishment of this object include reduced installation time, and consequent cost savings.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIGS. 1 and 2. Sheet two contains FIGS. 3 and 4. Sheet three contains FIGS. 5 and 6.

DETAILED DESCRIPTION OF THE PREFERRED EMBODIMENT

Figure 1:
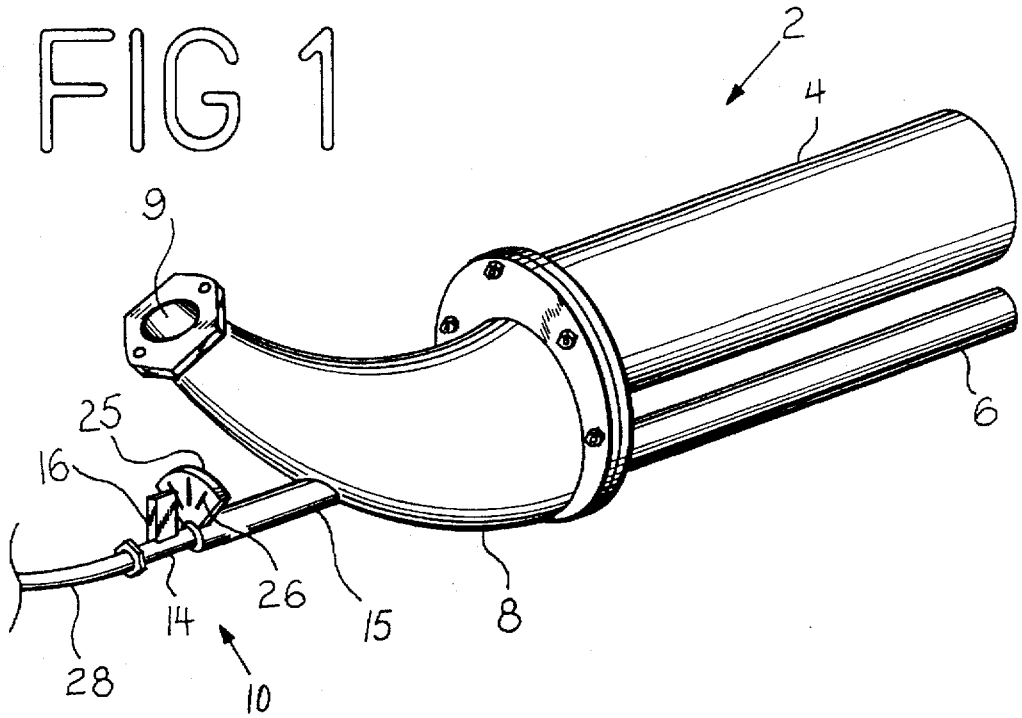
FIG. 1 is a front quarter isometric view of a triad exhaust system.
Figure 2:
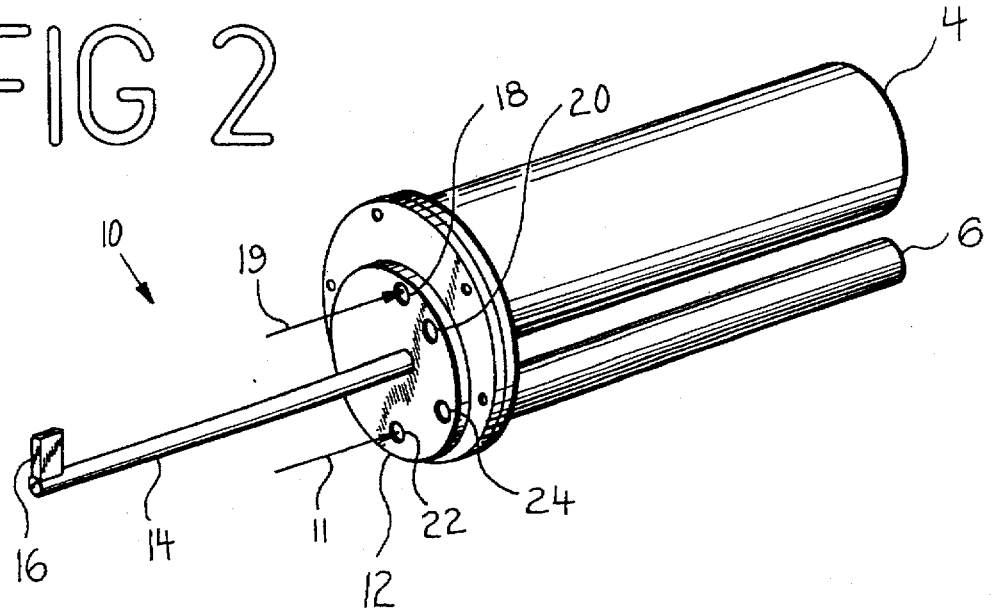
FIG. 2 is a front quarter isometric view of a diverter in the "BOTH" position rotatably engaged with a muffler and an exhaust pipe.

FIG. 1 is a front quarter isometric view of triad exhaust system 2. Triad exhaust system 2 comprises diverter 10 in rotatable engagement with exhaust manifold 8, muffler 4 and exhaust pipe 6. FIG. 2 is a from quarter isometric view of diverter 10 in the "BOTH" position. In the "BOTH" position, diverter 10 allows exhaust gasses from exhaust manifold 8 to pass both through muffler 4 as indicated by arrow 19, and exhaust pipe 6 as indicated by arrow 11.

Diverter 10 comprises diverter plate 12, diverter shaft 14, and diverter handle 16. Diverter plate 12 is rigidly attached to one extreme of diverter shaft 14; diverter handle 16 is rigidly attached to an extreme of diverter shaft 14 opposite diverter plate 12. Diverter plate 12 comprises diverter plate first muffler port 18, diverter plate second muffler port 20, diverter plate first exhaust pipe port 22 and diverter plate second exhaust pipe port 24. In the preferred embodiment, all diverter plate 12 ports terminate in a port nipple 62, as depicted in FIG. 6.

Figure 5:
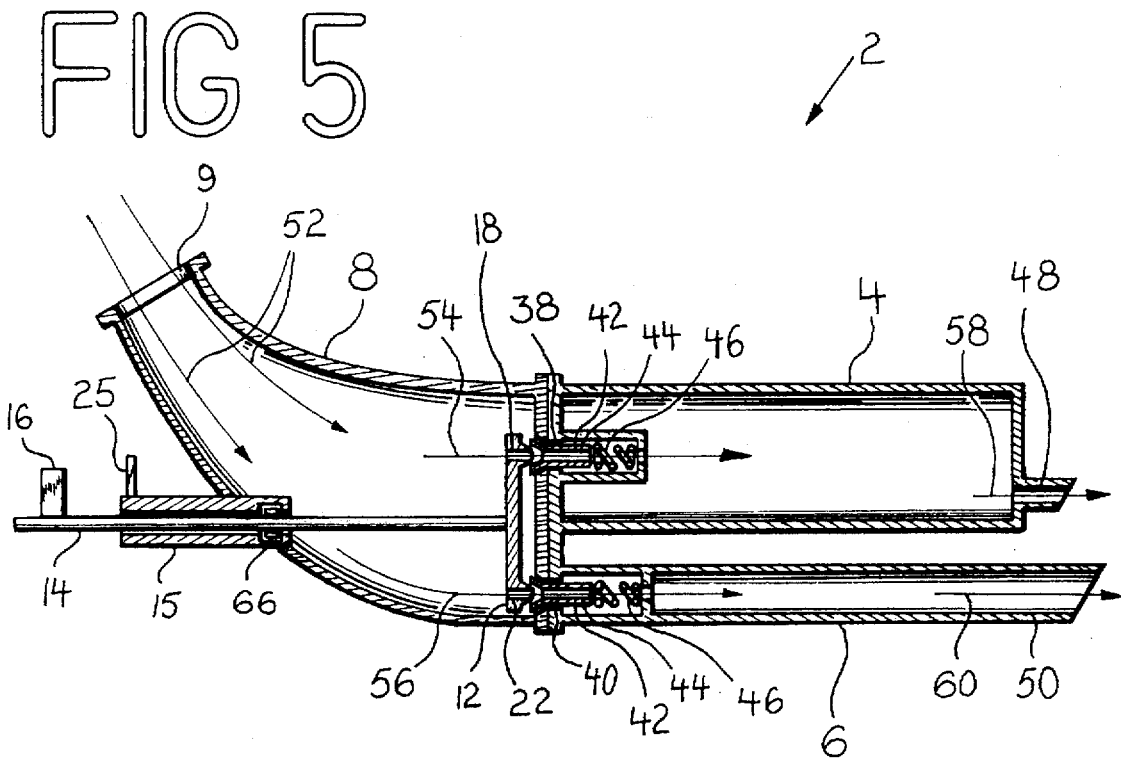
FIG. 5 is a cross sectional view of a triad exhaust system with the diverter in the "BOTH" position.

FIG. 5 is a cross sectional view of triad exhaust system 2 with diverter 10 in the "BOTH" position. Muffler 4 comprises muffler intake 38, sleeve 42 sized to reciprocate within muffler intake 38, and muffler outlet 48. Exhaust pipe 6 comprises exhaust pipe intake 40, sleeve 42 sized to reciprocate within exhaust pipe intake 40, and exhaust pipe outlet 50. Sleeves 42 comprise sleeve bore 44 communicating with sleeve dimple 64. Sleeve dimples 64 are sized to mate with port nipples 62.

Figure 6:
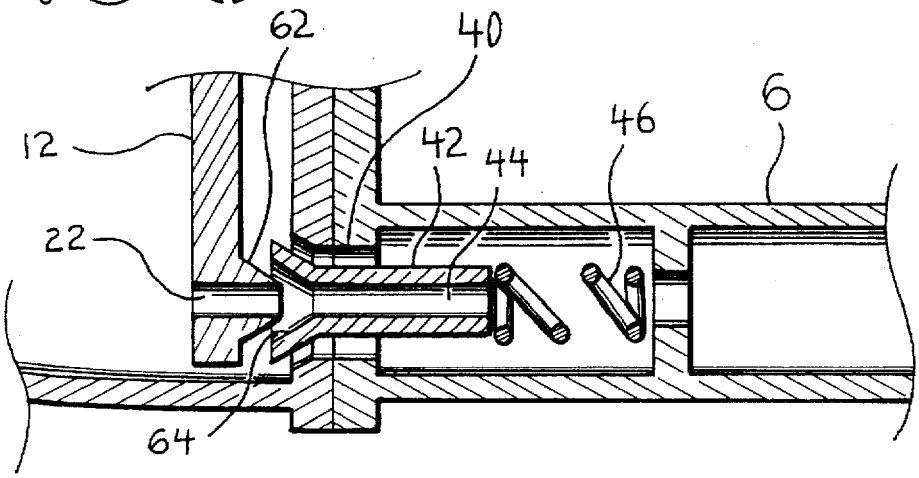
FIG. 6 is a cross sectional view of a diverter port nipple engaged with a sleeve dimple as urged by a spring.

FIG. 6 is a cross sectional view of diverter port nipple 62 engaged with sleeve dimple 64 as urged by spring 46. When diverter 10 is rotated relative to muffler 4 and exhaust pipe 6, port nipples 62 slide out of engagement with sleeve dimples 64 against springs 46. When diverter 10 is in the desired orientation relative to muffler 4 and exhaust pipe 6, the appropriate port nipple(s) 62 will be urged into engagement with corresponding sleeve dimple(s) 64, thus permitting exhaust gasses in exhaust manifold 8 to exit through muffler 4 only, exhaust pipe 6 only, or through both.

As may be observed in FIG. 1, diverter shaft 14 rotates within diverter shaft sleeve 15 attached to exhaust manifold 8. Quadrant 25 is attached to exhaust manifold 8, and bears indicia 26 which indicate the position of diverter 10: "MUFFLER ONLY", "EXHAUST PIPE ONLY", or "BOTH".

FIG. 5 shows the rotational attachment of diverter 10 to exhaust manifold 8. Diverter shaft sleeve 15 is rigidly attached to exhaust manifold 8. Diverter shaft 14 is sized to rotatably fit within diverter shaft sleeve 15. Diverter shaft sleeve 15 contains gas seal 66, which prevents exhaust gasses from escaping through diverter shaft sleeve 15. As is illustrated in FIG. 1, flexible cable 28 may be attached to diverter shaft 14 in order to operate triad exhaust system 2 from a remote location, such as a motorcycle's handlebars.

DIVERTER POSITIONS

Figure 3:
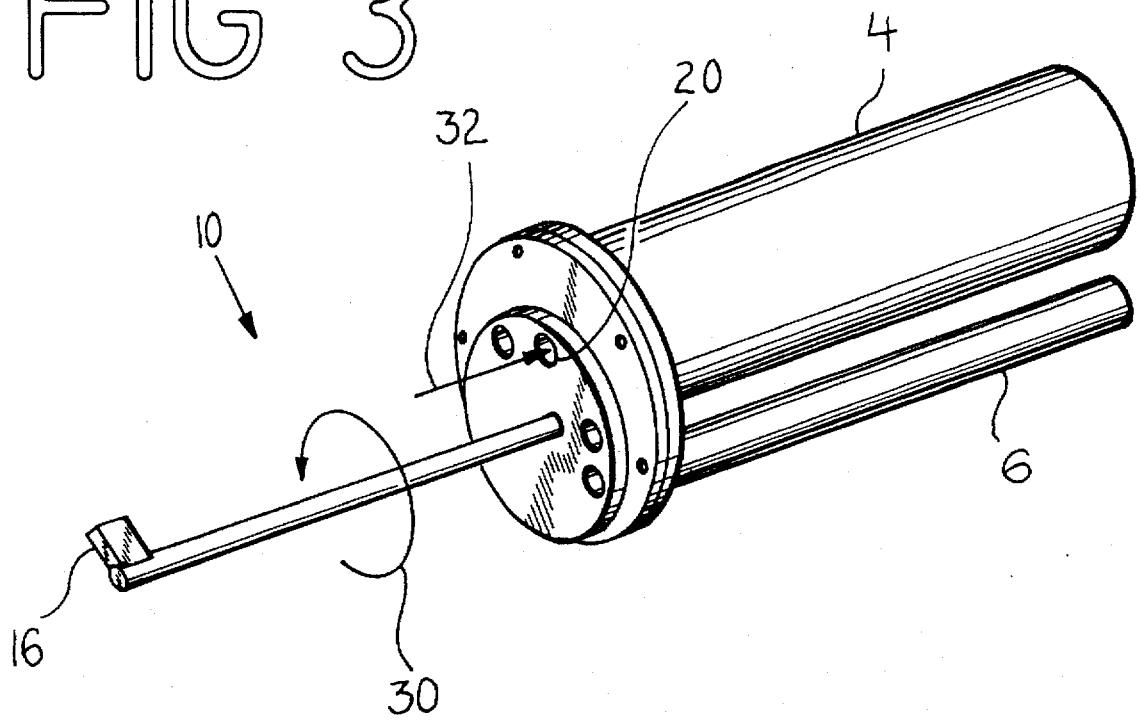
FIG. 3 is a front quarter isometric view of a diverter in the "MUFFLER ONLY" position rotatably engaged with a muffler and an exhaust pipe.
Figure 4:
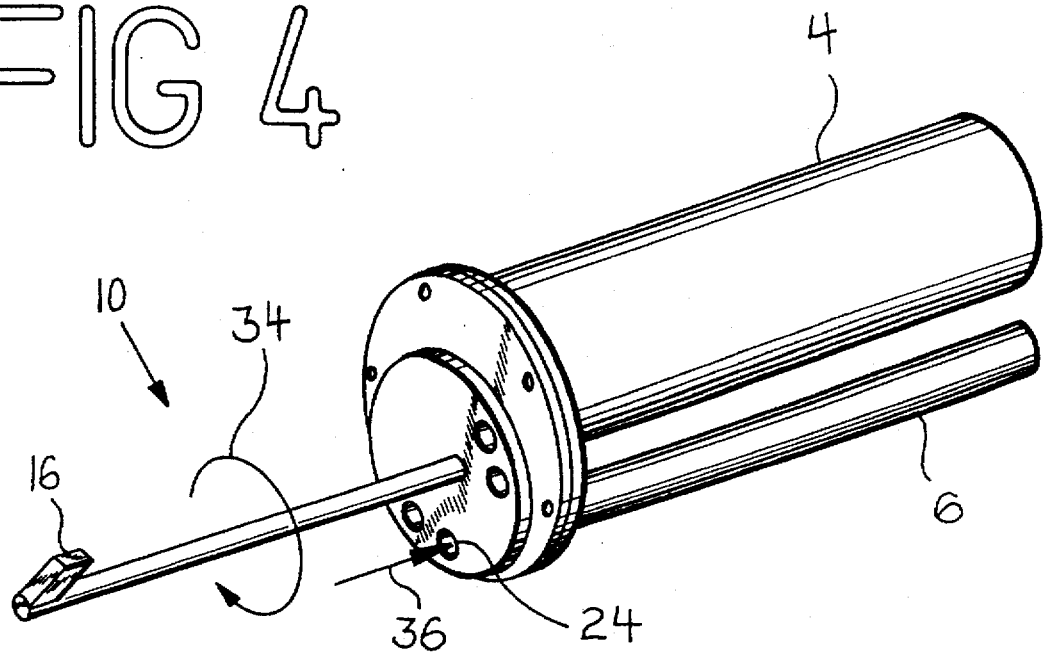
FIG. 4 is a front quarter isometric view of a diverter in the "EXHAUST PIPE ONLY" position rotatably engaged with a muffler and an exhaust pipe.

Diverter 10, in combination with sleeves 42, is essentially a three-position valve. The three positions are "MUFFLER ONLY", "EXHAUST PIPE ONLY" and "BOTH". FIGS. 1, 2, 5 and 6 depict diverter 10 in the "BOTH" position. FIG. 3 depicts diverter 10 in the "MUFFLER ONLY" position. FIG. 4 depicts diverter 10 in the "EXHAUST ONLY" position.

1. "BOTH" Position

FIGS. 1, 2, 5 and 6 depict diverter 10 in the "BOTH" position. In this position, exhaust gasses from exhaust manifold 8 may flow both through muffler 4 and exhaust pipe 6. This bifurcated exhaust gasses pathway is permitted by virtue of diverter 10 being positioned so as to align diverter plate first muffler port 18 with sleeve 42 in muffler intake 38, and so as to align diverter plate first exhaust pipe port 22 with sleeve 42 in exhaust pipe intake 40. Exhaust gasses within exhaust manifold 8 then are free to enter diverter plate first muffler port 18 as indicated by arrow 19, and diverter plate first exhaust pipe port 22 as indicated by arrow 11 (see FIG. 2).

The situation is shown in more detail in FIG. 5. Exhaust gasses enter exhaust manifold 8 through exhaust manifold intake 9, as indicated by arrows 52. Exhaust gasses within exhaust manifold 8 then egress into muffler 4 through diverter plate first muffler port 18 and sleeve 42 within muffler intake 38 as indicated by arrow 54, and into exhaust pipe 6 through diverter plate first exhaust pipe port 22 and sleeve 42 within exhaust pipe intake 40 as indicated by arrow 56.

Sleeve 42 sleeve dimple 64 within muffler intake 38 is urged into engagement with diverter plate first muffler port 18 port nipple 62 by spring 46. Sleeve 42 sleeve dimple 64 within exhaust pipe intake 40 is urged into engagement with diverter plate first exhaust pipe port 22 port nipple 62 by spring 46, as depicted in FIG. 6. Exhaust gasses within exhaust manifold 8 are prevented from escaping through diverter shaft sleeve 15 by gas seal 66.

From muffler 4, exhaust gasses then pass into the atmosphere through muffler outlet 48 as indicated by arrow 58. From exhaust pipe 6, exhaust gasses then pass into the atmosphere through exhaust pipe outlet 50 as indicated by arrow 60.

In the "BOTH" position, diverter 10 permits some exhaust gasses to escape through muffler 4, and some exhaust gasses to escape through exhaust pipe 6. In this position, a compromise between quietest operation and least power loss is achieved. For some motorcycles, this position may produce an acceptable sound level while still minimizing power loss.

2. "MUFFLER ONLY" Position

FIG. 3 depicts diverter 10 in the "MUFFLER ONLY" position. Diverter 10 has been rotated as indicated by arrow 30 until only diverter plate second muffler port 20 aligns with sleeve 42 in muffler intake 38. With diverter 10 thus oriented, sleeve 42 in exhaust pipe intake 40 is not aligned with any diverter plate 12 port. Thus the only escape for exhaust gasses from exhaust manifold 8 is through diverter plate second muffler port 20 and sleeve 42 within muffler intake 38, as indicated by arrow 32.

Sleeve 42 sleeve dimple 64 within muffler intake 38 is urged into engagement with diverter plate second muffler port 20 port nipple 62 by spring 46. Exhaust gasses within exhaust manifold 8 are prevented from escaping through diverter shaft sleeve 15 by gas seal 66.

In the "MUFFLER ONLY" position, diverter plate 10 channels all exhaust gasses through muffler 4. In this position, quietest operation is achieved, although at the cost of loss of power.

3. "EXHAUST PIPE ONLY" Position

FIG. 4 depicts diverter 10 in the "EXHAUST PIPE ONLY" position. Diverter 10 has been rotated as indicated by arrow 34 until only diverter plate second exhaust pipe port 24 aligns with sleeve 42 in exhaust pipe intake 40. With diverter 10 thus oriented, sleeve 42 in muffler intake 38 is not aligned with any diverter plate 12 port. Thus the only escape for exhaust gasses from exhaust manifold 8 is through diverter plate second exhaust pipe port 24 and sleeve 42 within exhaust pipe intake 40, as indicated by arrow 36.

Sleeve 42 sleeve dimple 64 within exhaust pipe intake 40 is urged into engagement with diverter plate second exhaust pipe port 24 port nipple 62 by spring 46, as depicted in FIG. 6. Exhaust gasses within exhaust manifold 8 are prevented from escaping through diverter shaft sleeve 15 by gas seal 66.

In the "EXHAUST PIPE ONLY" position, diverter 10 channels all exhaust gasses through exhaust pipe 6, and none through muffler 4. In this position, maximum power and maximum sound level are achieved—an optimum position for bike meets, cruising the highway with other bikers, etc.

It is envisioned that triad exhaust system 2 may be largely constructed of metal, ceramic, synthetic, or other appropriate material. Gas seal 66 may be a standard, bushing-type gas seal seated in diverter shaft sleeve 15 and encircling diverter shaft 14.

While a preferred embodiment of the invention has been illustrated herein, it is to be understood that changes and variations may be made by those skilled in the art without departing from the spirit of the appending claims.

DRAWING ITEM INDEX

2 triad exhaust system
4 muffler
6 exhaust pipe
8 exhaust manifold
9 exhaust manifold intake
10 diverter
11 arrow
12 diverter plate
14 diverter shaft
15 diverter shaft sleeve
16 diverter handle
18 diverter plate first muffler port
19 arrow
20 diverter plate second muffler port
22 diverter plate first exhaust pipe port
24 diverter plate second exhaust pipe port
25 quadrant
26 indicia
28 flexible cable
30 arrow
32 arrow
34 arrow
36 arrow
38 muffler intake
40 exhaust pipe intake
42 sleeve
44 sleeve bore
46 spring
48 muffler outlet
50 exhaust pipe outlet
52 arrow
54 arrow
56 arrow
58 arrow
60 arrow
62 port nipple
64 sleeve dimple
66 gas seal

I claim:

1. A triad exhaust system comprising a diverter rotatably engageable with a muffler and an exhaust pipe, said muffler comprising a muffler intake, said exhaust pipe comprising an exhaust pipe intake, said diverter comprising a diverter plate, a diverter plate first muffler port sized to engage said muffler intake and a diverter plate first exhaust pipe port sized to engage said exhaust pipe intake disposed in said diverter plate.

2. The triad exhaust system of claim 1 wherein said diverter plate further comprises a diverter plate second muffler port sized to engage said muffler intake and a diverter plate second exhaust pipe port sized to engage said exhaust pipe intake.

3. The triad exhaust system of claim 1 further comprising a sleeve sized to engage said diverter plate first muffler port slidably disposed within said muffler intake, and a sleeve sized to engage said diverter plate first exhaust pipe port slidably disposed within said exhaust pipe intake.

4. The triad exhaust system of claim 3 further comprising a spring urging the muffler intake sleeve into engagement with said diverter plate first muffler port or alternatively into contact with said diverter plate, and a spring urging the exhaust pipe intake sleeve into engagement with said diverter plate first exhaust pipe port or alternatively into contact with said diverter plate.

5. The triad exhaust system of claim 4 wherein said muffler intake sleeve comprises a sleeve bore communicating with a sleeve dimple, said diverter plate first muffler port terminates in a port nipple sized to mate with the muffler intake sleeve dimple, said exhaust pipe intake sleeve comprises a sleeve bore communicating with a sleeve dimple, and said diverter plate first exhaust pipe port terminates in a port nipple sized to mate with the exhaust pipe intake sleeve dimple.

6. The triad exhaust system of claim 2 further comprising a sleeve sized to engage said diverter plate first muffler port and said diverter plate second muffler port slidably disposed within said muffler intake, and a sleeve sized to engage said diverter plate first exhaust pipe port and said diverter plate second exhaust pipe port slidably disposed within said exhaust pipe intake.

7. The triad exhaust system of claim 6 further comprising a spring urging the muffler intake sleeve into engagement with said diverter plate first muffler port or alternatively into engagement with said diverter plate second muffler port or alternatively into contact with said diverter plate, and a spring urging the exhaust pipe intake sleeve into engagement with said diverter plate first exhaust pipe port or alternatively into engagement with said diverter plate second exhaust pipe port or alternatively into engagement with said diverter plate.

8. The triad exhaust system of claim 7 wherein said muffler intake sleeve comprises a sleeve bore communicating with a sleeve dimple, said diverter plate first muffler port and said diverter plate second muffler port each terminate in a port nipple sized to mate with the muffler intake sleeve dimple, said exhaust pipe intake sleeve comprises a sleeve bore communicating with a sleeve dimple, and said diverter plate first exhaust pipe port and said diverter plate second exhaust pipe port each terminate in a port nipple sized to mate with the exhaust pipe intake sleeve dimple.

9. The triad exhaust system of claim 1 wherein said diverter further comprises a diverter shaft rigidly attached to said diverter plate, and a diverter handle rigidly attached to an extreme of said diverter shaft opposite said diverter plate.

10. The triad exhaust system of claim 9 further comprising a quadrant beating indicia, whereby a position of said diverter may be ascertained.

11. The triad exhaust system of claim 10 further comprising a diverter shaft sleeve sized to slidably admit said diverter shaft, said quadrant being mounted to said diverter shaft sleeve.

12. The triad exhaust system of claim 11 further comprising an exhaust manifold mounted to said muffler and said exhaust pipe, said diverter shaft sleeve extending through said exhaust manifold, and a gas seal around said diverter shaft within said diverter shaft sleeve, whereby exhaust gasses within said exhaust manifold are prevented from leaking out through said diverter shaft sleeve.

13. The triad exhaust system of claim 1 further comprising a flexible cable attached to said diverter whereby said diverter may be rotated relative to said muffler and exhaust pipe from a remote location.

* * * * *

UNITED STATES PATENT AND TRADEMARK OFFICE

CERTIFICATE OF CORRECTION

PATENT NO. : 5,743,088
DATED : April 28, 1998
INVENTOR(S) : Francis R. Grath

It is certified that error appears in the above-indentified patent and that said Letters Patent is hereby corrected as shown below:

| | |
|---|---|
| Abstract line 17 | "...motor cycle..." *should read* "...motorcycle..." |
| Column 1 line 33 | "...loud ramble..." *should read* "...loud rumble..." |
| Column 1 line 46 | "...for others..." *should read* "...for others'..." |
| Column 3 line 11 | "...is a from quarter isometric view..." *should read* "...is a front quarter isometric view....." |
| Column 7 line 10 | "...quadrant beating indicia..." *should read* "...quadrant bearing indicia..." |

Signed and Sealed this

Twenty-fifth Day of August, 1998

Bruce Lehman

*Attest:*

BRUCE LEHMAN

*Attesting Officer*

*Commissioner of Patents and Trademarks*